US007610965B2

(12) United States Patent
Pennison et al.

(10) Patent No.: US 7,610,965 B2
(45) **Date of Patent: *Nov. 3, 2009**

(54) ARM FOR MOVING FLEXIBLE LINES AT A WELL SITE

(75) Inventors: Dennis Pennison, Laforche Parish, LA (US); William E. Coyle, Jr., Terrebonne Parish, LA (US)

(73) Assignee: Bilco Tools, Inc., Houma, LA (US)

( * ) Notice: Subject to any disclaimer, the term of this patent is extended or adjusted under 35 U.S.C. 154(b) by 384 days.

This patent is subject to a terminal disclaimer.

(21) Appl. No.: 10/982,861

(22) Filed: Sep. 24, 2004

(65) Prior Publication Data

US 2006/0065404 A1 Mar. 30, 2006

(51) Int. Cl.
*E21B 19/00* (2006.01)

(52) U.S. Cl. ..... 166/380; 166/77.1; 166/85.5; 166/97.5

(58) Field of Classification Search ..... 166/380, 166/77.1, 77.2, 85.5, 96.1, 97.5
See application file for complete search history.

(56) References Cited

U.S. PATENT DOCUMENTS

| | | | | |
|---|---|---|---|---|
| 2,667,333 | A * | 1/1954 | Martin | 173/81 |
| 4,274,778 | A | 6/1981 | Putnam et al. | |
| 4,281,716 | A | 8/1981 | Hall | |
| 5,503,234 | A | 4/1996 | Clanton | |
| 6,131,664 | A | 10/2000 | Sonnier | |
| 2004/0079533 | A1 | 4/2004 | Buytaert et al. | |
| 2005/0161225 | A1 * | 7/2005 | Cole et al. | 166/379 |
| 2005/0161227 | A1 * | 7/2005 | Hayes et al. | 166/380 |
| 2006/0027375 | A1 * | 2/2006 | Thomas et al. | 166/380 |
| 2006/0065407 | A1 * | 3/2006 | Rufey | 166/384 |
| 2006/0090901 | A1 * | 5/2006 | Pennison et al. | 166/379 |
| 2006/0108122 | A1 * | 5/2006 | Buytaert et al. | 166/379 |
| 2006/0137884 | A1 * | 6/2006 | Torres | 166/380 |

* cited by examiner

*Primary Examiner*—Jennifer H Gay
*Assistant Examiner*—Robert E Fuller
(74) *Attorney, Agent, or Firm*—Browning Bushman P.C.

(57) ABSTRACT

A movable arm 10 engages a flexible line 50 at a well site for positioning the flexible line between run-in position for passing the flexible line with a tubular through a well hole in the rig floor and a clamping position wherein the flexible line is adjacent the tubular above the rig floor for clamping the line to the tubular. The arm 10 extends upward from the rig floor 70, and includes a line guide, such as roller 12, for engaging the flexible line when in the run-in position. A powered drive 14 moves the arm between the run-in position and the clamping position. A spacer 82 may be used for positioning two or more flexible lines at a desired spacing relative to one another prior to positioning the lines within a clamp secured to the tubular. A slip bowl assembly 60 may be laterally movable so that slips do not engage the flexible line as it is run in the well.

58 Claims, 13 Drawing Sheets

FIG 10
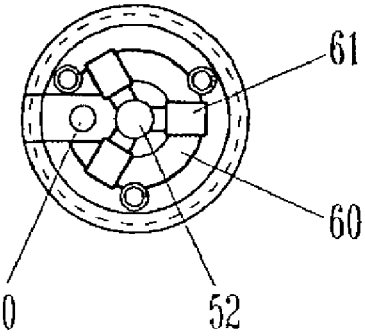
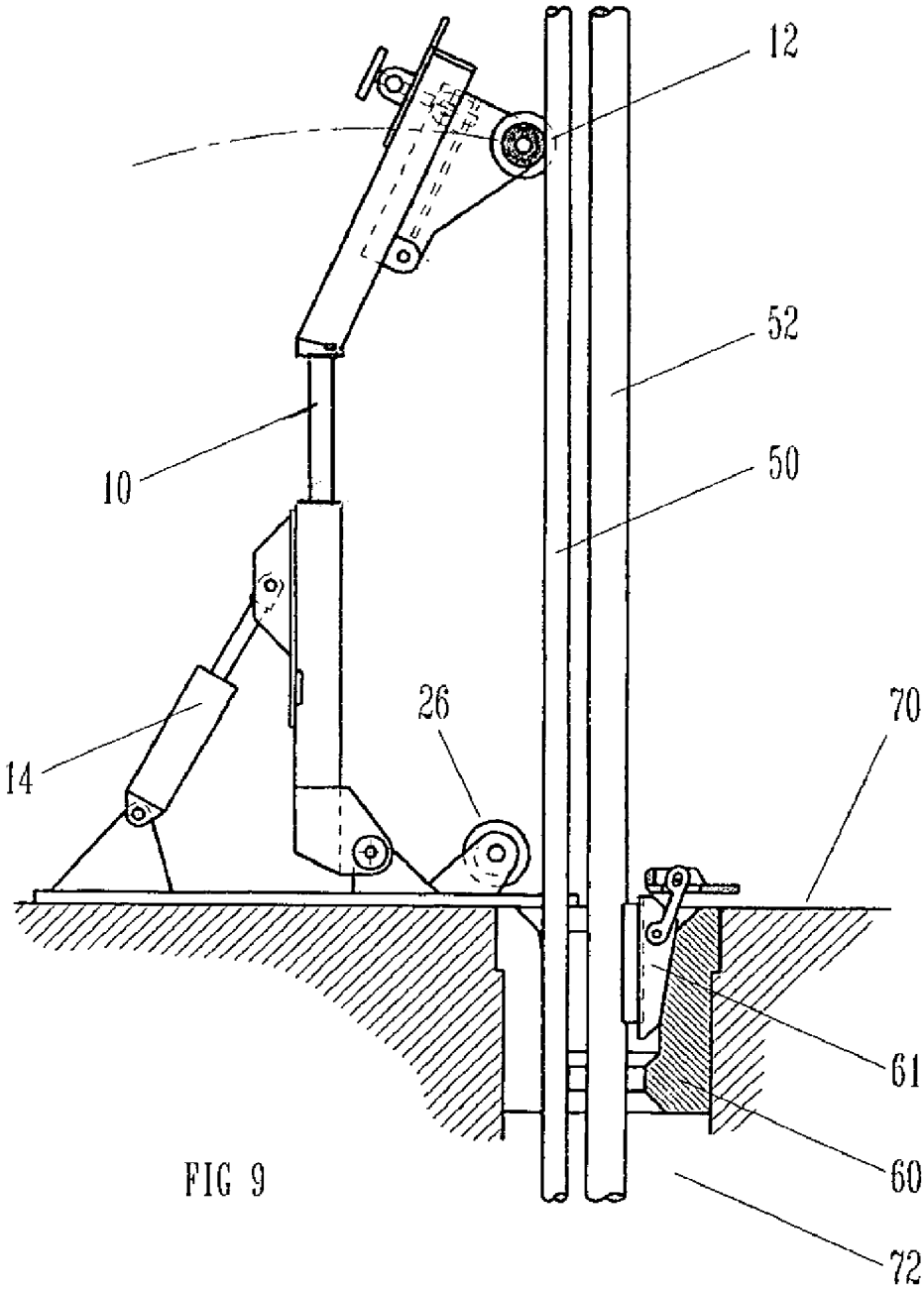
FIG 9

ARM FOR MOVING FLEXIBLE LINES AT A WELL SITE

FIELD OF THE INVENTION

The present invention relates to an arm for engaging a flexible line, such as a control line, at a well site to position the line between a run-in position for passing the flexible line with the tubular through a well hole in the rig floor and a clamping position wherein the flexible line is adjacent the tubular for clamping the flexible line to the tubular. More particularly, the present invention relates to a moveable arm for engaging a flexible line at a well site, to a flexible line spacer for spacing a plurality of flexible lines with respect to each other for positioning the lines within a clamp which is secured to the tubular, and to a slip bowl assembly laterally movable relative to the well hole in the rig floor.

BACKGROUND OF THE INVENTION

Flexible lines, such as hydraulic, electrical or fiberoptic control lines coiled on a spool, are commonly run in a well with a tubular, thereby preventing the lines from substantial movement while in the annulus surrounding the tubular. These flexible control lines are commonly used to control the operation of various downhole equipment, including safety valves and subsea blowout preventers (BOPs). Control lines may be used to received data from downhole instruments and to selectively operate downhole instruments, such as valves, switches, sensors and relays from the surface. Flexible lines may also be used for corrosion control or to treat fluids produced from the well. The control lines and the tubular may thus extend through the spider or slip bowl assembly used to support the tubular string from the rig floor. The lines are conventionally clamped to the tubular at the well site above the spider or slip bowl assembly which is positioned on the rig floor, so that the tubular string and the control lines together are run in the well.

A spider or slip bowl assembly is a device used on the drilling rig for grasping and supporting a tubular string as the tubular joints are made up into the string. A spider or slip bowl assembly has an interior bore and circumferentially arranged slips disposed around the string and within the interior bore. The slips move radially inward to grip the outer surface of the tubular and support the tubular in the well when the tubular string is not supported by an elevator. In some operations, it is practical to position the spider over the well hole to grip the tubular, and to move the spider laterally away from the well hole when running the tubular and the control lines into the well.

Various problems have existed for years in positioning the control lines for the clamps to secure the lines to the tubular while also allowing other apparatus, such as elevators and power tongs, to manipulate or operate on the tubular without damaging the control lines. The time required to position and clamp flexible lines to the tubular inherently delays the run-in process and may cost an operator tens of thousands of dollars in personnel costs and rig daily rental.

In one approach, a flexible line coiled on a drum may be guided by an arm extending generally downward from the rig mast, with a roller on the end of the arm. The roller may be spaced 25 feet or more above the rig floor, and positions the flexible line generally adjacent a perimeter of the tubular, so that the flexible line can extend down and be positioned within the clamp for clamping to the tubular. A significant problem with this arrangement is the cost of installing and properly adjusting the arm on the rig mast. Also, a flexible line extending downward from the roller may move laterally a foot or more from the vertical position of the roller, in which case manual labor by the rig hands is required to physically push or pull the line back to the position wherein the flexible line may be clamped to the tubular.

In view of the above problems, others have incurred the expense of inserting the flexible lines and clamping the lines to the tubular at a position below the spider or slip bowl assembly and above the rig floor. In this case, the spider is positioned a substantial distance above the rig floor to allow an operator sufficient space between the rig floor and the spider to clamp the control lines to the tubular. Examples of this technology are shown in U.S. Pat. No. 6,131,644 and U.S. 2004/00795338A1.

In offshore applications, it is frequently necessary to utilize several control lines with each tubing string. Multiple lines may be attached to the tubular in a circumferential arrangement that permits the lines to clear the slip segments in the spider or in the slip bowl assembly. When multiple lines are utilized, more time is required to position each line with respect to other lines so that all lines are properly positioned within the tubular clamp.

The disadvantages of prior art are overcome by the present invention, and improved equipment and techniques are provided for positioning a flexible line to be clamped to a tubular when the flexible line and tubular are run in the well.

SUMMARY OF THE INVENTION

In one embodiment, a moveable arm for engaging a flexible line at a well site positions the flexible line between a run-in position spaced from the tubular above the rig floor for passing the flexible line with the tubular through a well hole in the rig floor, and a clamping position wherein the flexible line is adjacent the tubular above the rig floor for clamping the flexible line to the tubular. The moveable arm comprises an arm extending upward from the rig floor, at least one flexible line guide adjacent an upper end of the arm for engaging the flexible line when in the clamping position, and a powered drive for moving the arm between the run-in position and the clamping position. A slip bowl assembly may be laterally movable from a position over the well hole to a position spaced laterally from the well hole to prevent damage to the flexible lines as the tubular and flexible lines are run in the well. The tubular and flexible lines may thus pass through a slip bowl setting plate while the slip bowl assembly is spaced from the well hole.

In one embodiment, the flexible line guide is a roller rotatably mounted to the arm. A lower roller may also be provided for engaging the flexible arm when the arm is in the run-in position. The arm may be pivotally secured to a base of the slip bowl assembly, or the arm may be connected to the slip bowl of the slip bowl assembly, which optionally is laterally moveable relative to the rig floor. The hydraulic system for powering the slip bowl assembly may also power the powered drive for moving the arm. In yet another embodiment, the arm is supported on the rig floor. An adjustment mechanism is preferably provided for positioning at least one roller relative to the arm.

In a preferred embodiment, the flexible line guide is positioned less than ten feet above the rig floor when the arm is in the clamping position. A line spacer may be manually positioned by an operator to space each of the plurality of flexible lines at a desired spacing for clamping the lines to the tubular. In the alternative, the line spacer may be adjustably positioned at the upper end of the arm, and may be provided either above or below the roller mounted at the upper end of the arm.

The line spacer preferably includes a plurality of slots, with each slot sized to received a respective flexible line. The line spacer is thus used to space the flexible lines relative to one another prior to clamping the lines to the tubular.

A significant advantage is that the time required to properly set up and adjust the arm is minimal. A further advantage is that the adjustable arm may be used with various types of slip bowl assemblies or spiders.

These and further features and advantages of the present invention will become apparent from the following detailed description, wherein reference is made to the figures in the accompanying drawings.

BRIEF DESCRIPTION OF THE DRAWINGS

FIG. 9 is yet another embodiment of an arm used with a flush mounted slip bowl assembly in the clamping position.

FIG. 10 is a top view of the slip bowl assembly shown in FIG. 9.

DETAILED DESCRIPTION OF THE PREFERRED EMBODIMENT

Figure 1:
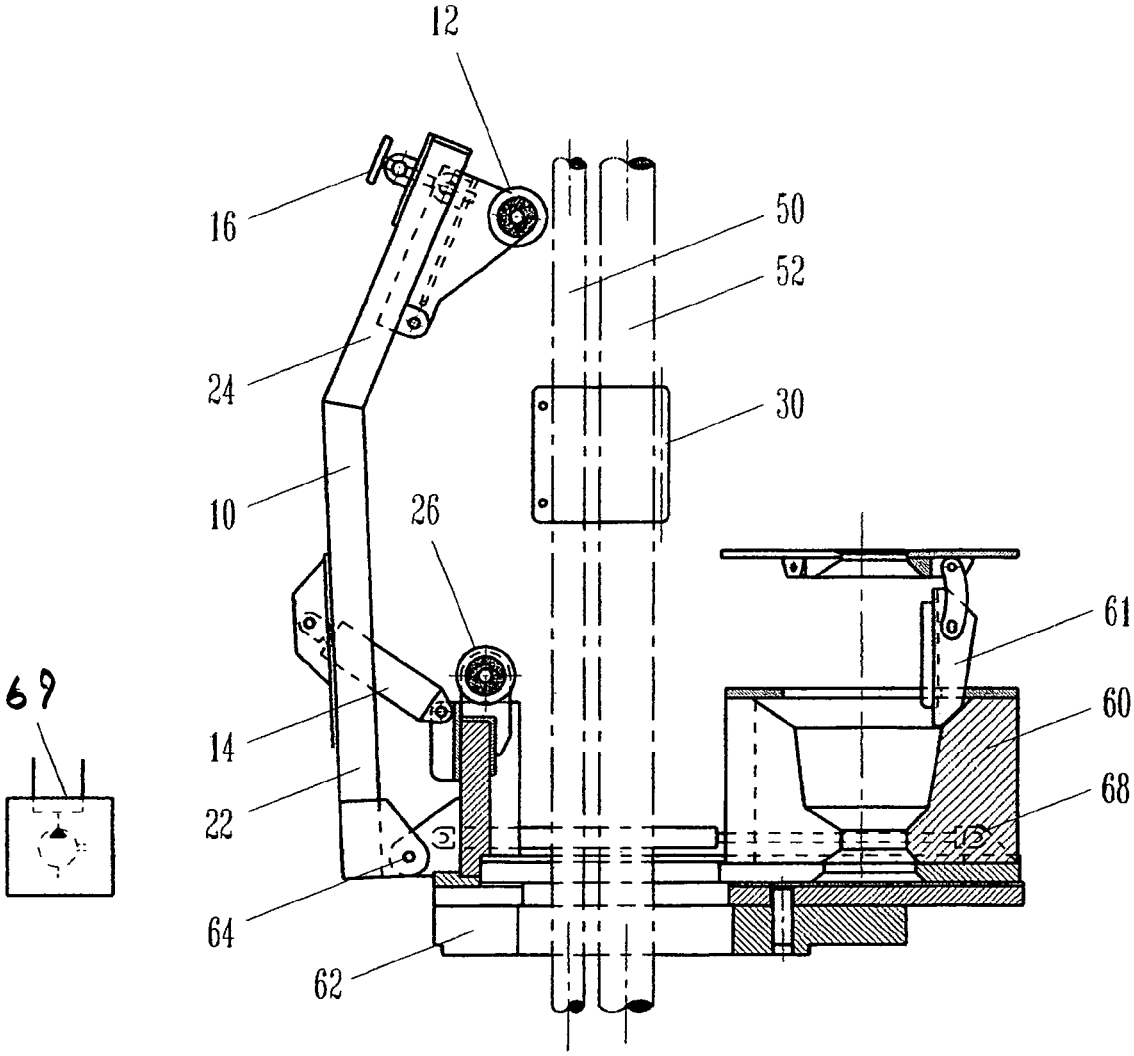
FIG. 1 is a side view of one embodiment of an arm according to the present invention, with the arm in the clamping position.
Figure 3:
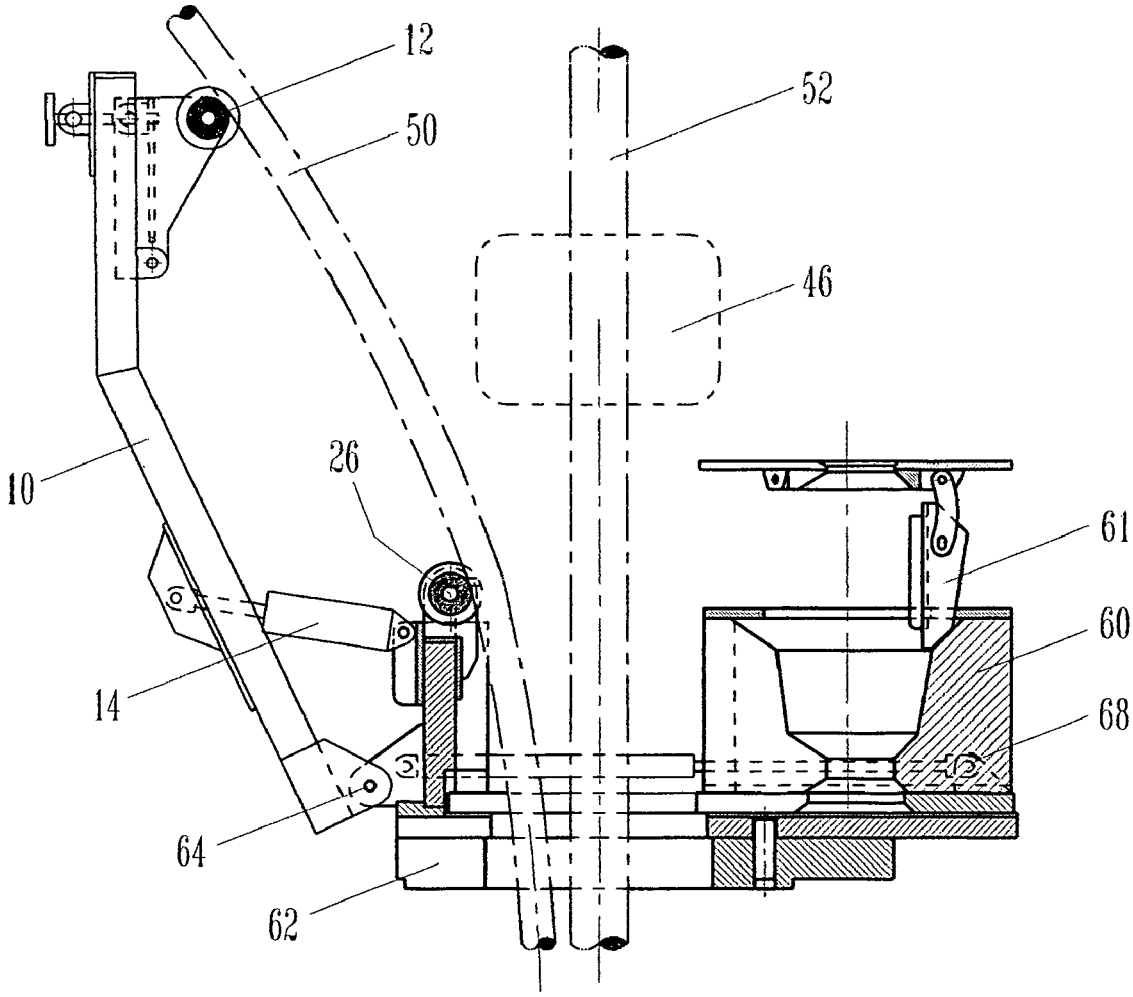
FIG. 3 depicts the embodiment of FIG. 1 in the run-in position.

FIG. 1 depicts one embodiment of a moveable arm 10 engaging a flexible line 50 at a well site for positioning the line between a clamping position, as shown in FIG. 1, for clamping the flexible line to a tubular 52, and a run-in position, as shown in FIG. 3, wherein the flexible line is spaced from the tubular for allowing equipment to engage the tubular and to run the flexible line with the tubular into the well. As shown in FIG. 1, the moveable arm 10 extends upward from the rig floor on which the base or plate 62 of the slip bowl assembly 60 is positioned. Arm 10 includes a lower arm portion 22 which is pivotally connected at 64 to the base or plate 62 of the slip bowl assembly 60, and an upper arm portion 24 which is inclined or canted relative to lower arm portion 22. A roller 12 is pivotally mounted on the upper arm portion 24, and serves as a flexible line guide for engaging the flexible line 50 when in the run-in position. The adjustment mechanism 16 comprising a threaded rod and a rotating handle may be used for adjusting the position of roller 12 relative to the arm. Other adjustment mechanisms may be used for adjusting the position of roller 12. Movement of the arm between the position as shown in FIG. 1 and the position as shown in FIG. 3 is accomplished by a powered drive, which preferably is a hydraulic cylinder 14, which acts between the base or plate 62 of the slip bowl assembly and the lower portion of the arm 10. A lower roller 26 is provided in engaging the flexible line 50 when the arm is in the run-in position, as shown in FIG. 3.

Figure 2:
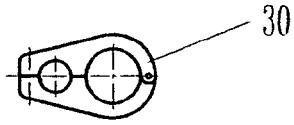
FIG. 2 is a top view of the clamp shown in FIG. 1.

With the flexible line 50 properly positioned by the arm and the roller 12, a suitable clamp, such as clamp 30 shown in FIG. 2, may be clamped about the tubular 52 and about the flexible line 50, thereby securing the flexible line in position to the tubular so that both the tubular 52 and the flexible line 50 are run together in the well. After the clamp 30 is installed, the spider or slip bowl assembly 60 may be moved laterally from the centerline of the well. Alternatively, the slip bowl assembly 60 may be off the well centerline when the clamp is installed. The slip bowl assembly is centered over the well when tongs make up the pipe. FIG. 1 shows a slip bowl assembly 60 moved laterally off its position over the well hole in the rig floor. Those skilled in the art will appreciate that hydraulic cylinder 68 or other drive mechanism may be actuated to laterally move the slip bowl assembly to the position spaced from the well hole, as shown in FIG. 1, and to return the slip bowl assembly to a position centered over the well hole to grip the tubular. Those skilled in the art will further appreciate that the line 50 as shown in FIG. 1 is a substantially flexible line compared to the rigid tubular 52, and may comprise one or more electric, hydraulic or fiberoptic lines.

In a preferred embodiment, hydraulic system 69 as shown in FIG. 1 may be used to power both the cylinder 68 for translation of the slip bowl assembly 60, and the cylinder 14 for moving the hydraulic arm 10. A feature of the invention is that the roller or other guide member 12 at the end of the arm for engaging and guiding the flexible line 50 when in the clamping position is positioned fairly close to the rig floor. In a preferred embodiment, the roller 12 is positioned approximately 10 feet or less from the rig floor in the clamping position, thereby providing sufficient room for an operator to position the clamp 30 on the tubular 52 and the flexible line 50, while also realizing a fairly short spacing, typically three or four feet or less, between the top of the clamp 30 and the roller 12 at the upper end of the arm 10, thereby ensuring that the flexible line 50 does not move laterally a substantial distance from the position obtained by the roller 12 to the position when the clamp 30 clamps the flexible line to the tubular 52. Those skilled in the art will appreciate that a single hydraulic system 69 may power the slip bowl assembly and the arm 10 from each of the embodiments shown.

FIG. 3 shows the arm 10 moved to a run-in position so that tongs, elevators and other tools can engage and operate on the tubular 52 without damaging the flexible line 50, which conventionally extends from a reel as shown subsequently into the well. An exemplary tool 46 is shown in the dashed lines in FIG. 3 for working on the tubular string. When the tubular and flexible lines are run in a well, the slip bowl assembly 60 is preferably laterally spaced from the well hole to prevent damage to the control lines. The tubular 52 and lines 50 pass through a slip bowl setting plate 62 when the slip bowl assembly 60 is spaced from the well hole.

Figure 6:
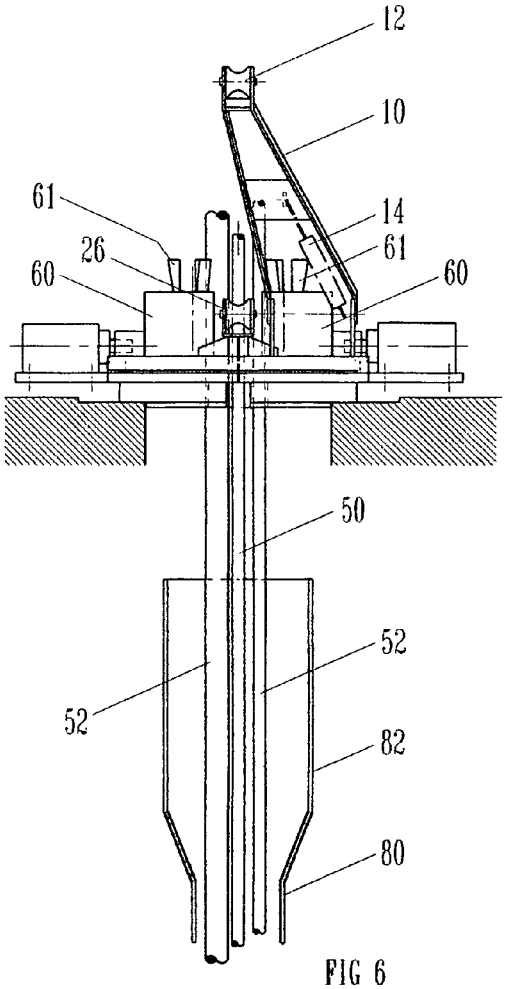
FIG. 6 is the FIG. 4 embodiment in the run-in position.
Figure 4:
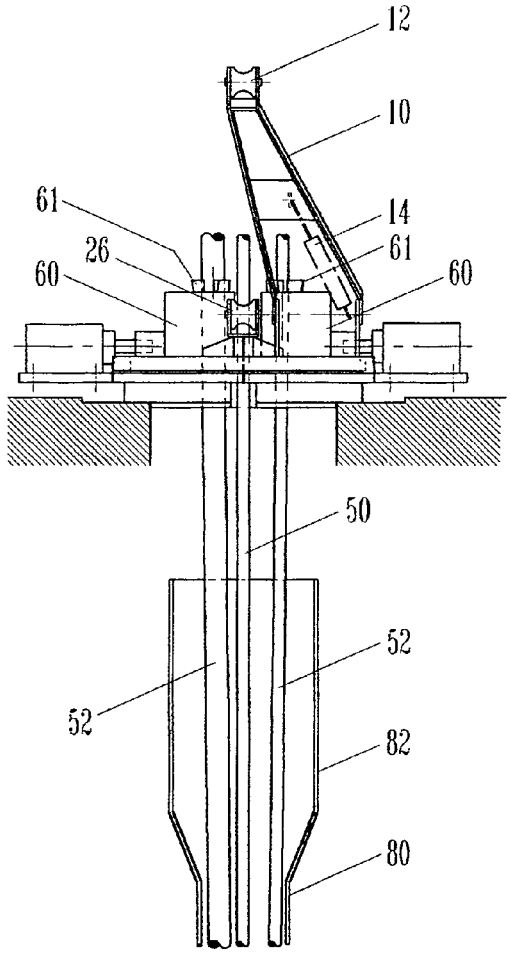
FIG. 4 depicts another embodiment of an arm in the clamping position.

FIG. 4 depicts an alternate embodiment of an arm 10 including an upper roller 12 for engaging a flexible line, and a roller 26 positioned approximately two feet above the rig floor 70. With the embodiment as shown in FIG. 4, the flexible line 50 is substantially angled beneath the rig floor 70 when in the run-in position, as shown in FIG. 6, and accordingly the conductor or outer casing 80 has an enlarged upper section 82 for accommodating the bend of the flexible line 50, as shown in FIGS. 4 and 6. In the FIG. 4 embodiment, the arm 10 comprises a pair of arm members which are pivotally connected to a base of the slip bowl assembly and support the upper roller 12.

Figure 5:
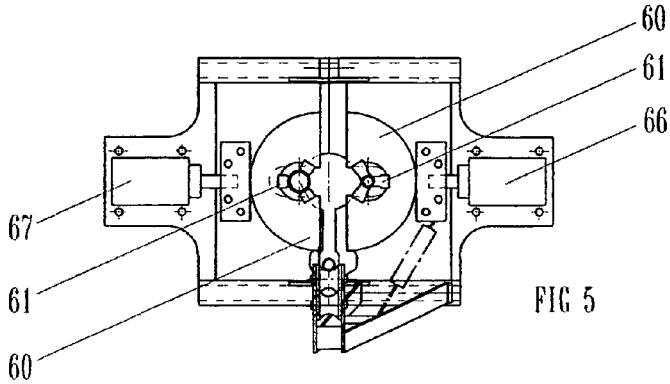
FIG. 5 is a top view of the FIG. 4 embodiment.

FIG. 5 depicts a slip bowl assembly 60 which, in this case, is a split bowl assembly, such that the hydraulic cylinder 66 may be activated to move the right side of the slip bowl assembly laterally to the right, while the cylinder 67 may be similarly actuated to move the left side of the slip bowl assembly to the left.

Figure 7:
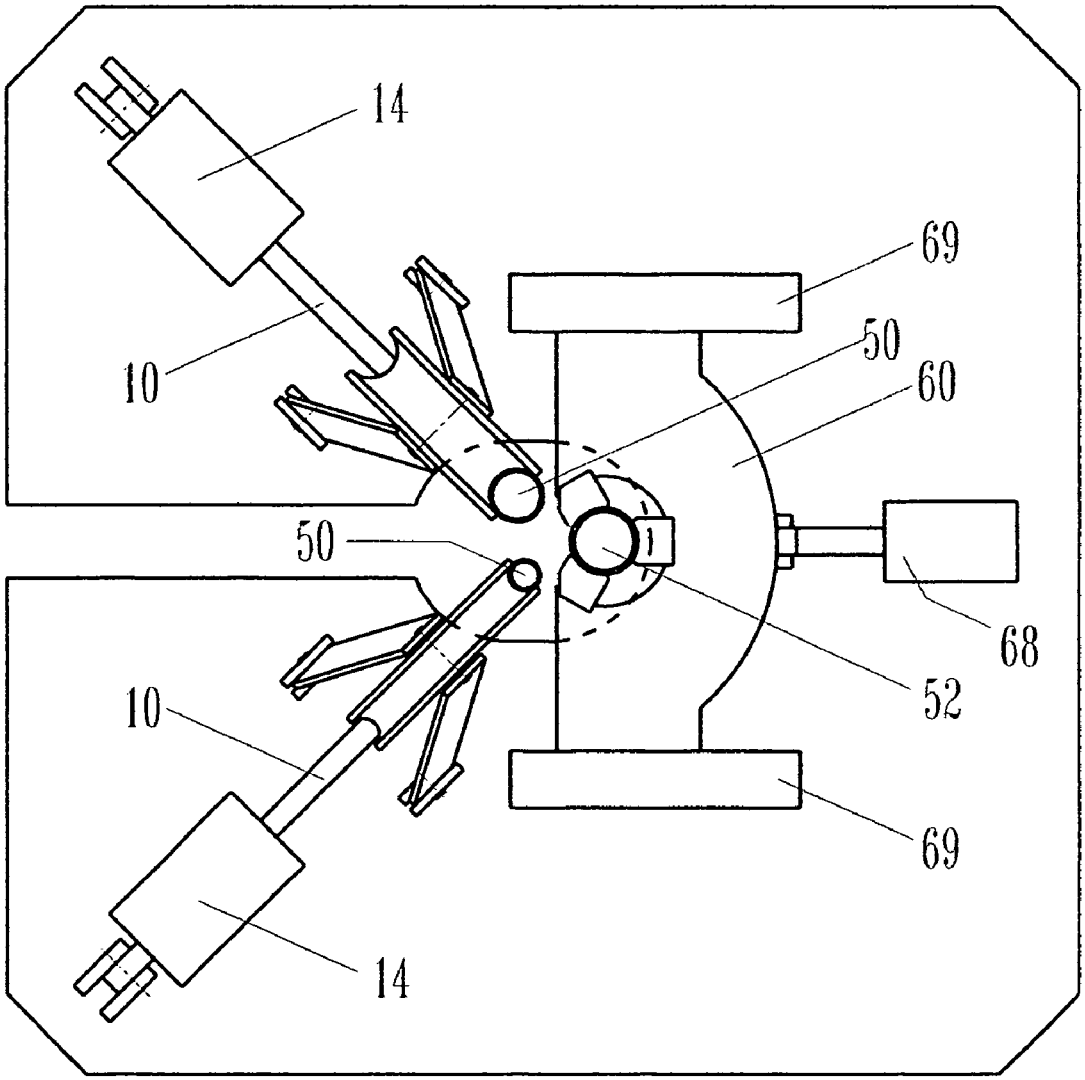
FIG. 7 is a top view illustrating two arms each for positioning a flexible line above a spider.

FIG. 7 illustrates an embodiment wherein a pair of arms 10 are each provided with a powered cylinder 14 for positioning two different flexible lines 50 relative to the tubular 52. The slip bowl assembly 60 is positioned between guides 69 and is powered by cylinder 68 to move laterally on and off the tubular 52.

Figure 8:
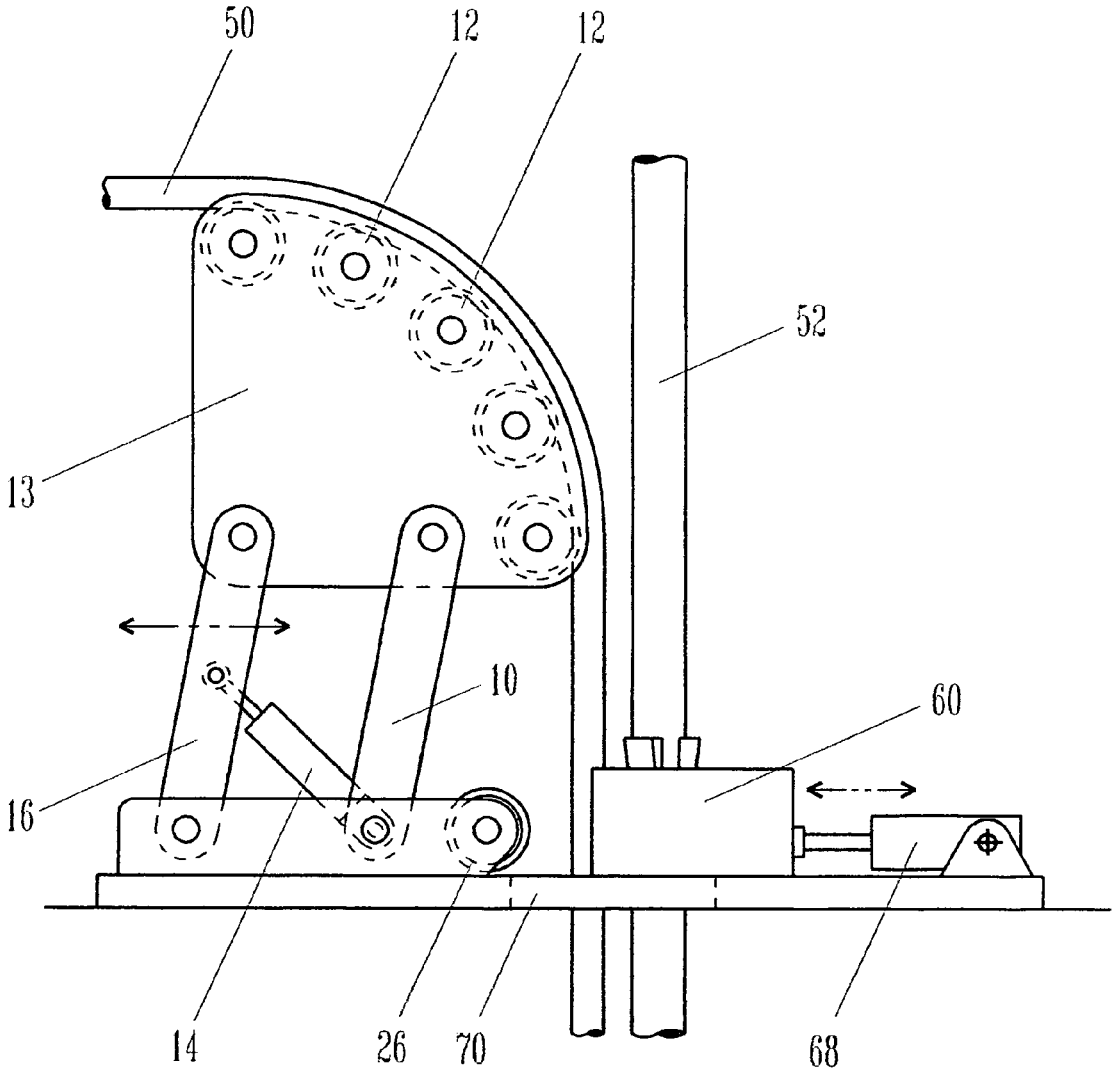
FIG. 8 depicts another embodiment of an arm for guiding a flexible line.

FIG. 8 discloses an alternate embodiment, when the flexible line 50 is guided by a plurality of rollers 12 each mounted on roller support 13 provided at the upper end of two arms 10, with hydraulic cylinder 14 controlling movement of the arms and thus movement of the rollers 12 between the clamping position, shown in FIG. 8, and the run-in position. The slip bowl assembly 60 may be moved laterally relative to the rig floor by the powered cylinder 68 from a position wherein the assembly 60 is centered over the well hole in the rig floor to a position wherein the slip bowl assembly is laterally spaced from the well hole.

FIG. 9 discloses yet another embodiment of an arm 10 powered by hydraulic cylinder 14 for moving flexible line 50 into a clamping position adjacent the tubular 52. A lower roller 26 is provided for engaging the flexible line 50 when in the run-in position. In this application, the slip bowl assembly 60 is placed within the rig floor, and the top of the slip bowl assembly 60 is substantially flush with the top of the rig floor 70. Both the tubular 52 and the flexible line 50 thus pass through the rig floor and into the well hole 72 in the rig floor. FIG. 10 is a top view showing the slips 61 of slip bowl assembly 60 and the position of the tubular 52 and the flexible line 50. Slips are not shown in all figures, but those skilled in the art will appreciate that slips are conventionally provided within each of the slip bowls shown.

Figure 11:
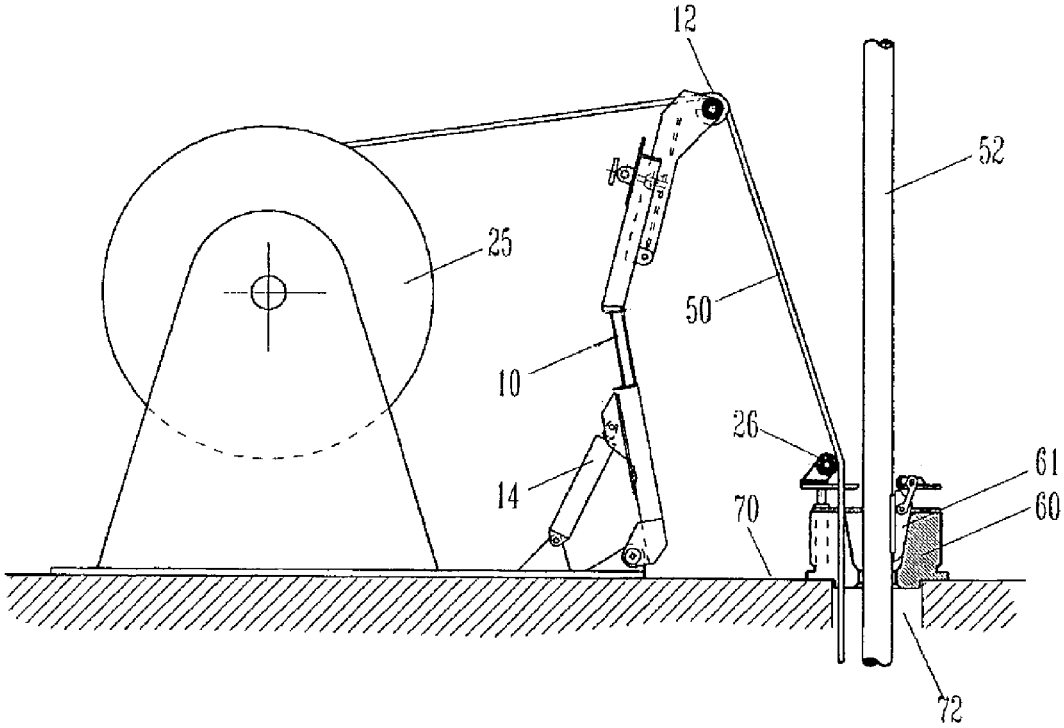
FIG. 11 is a side view of an arm supported on the rig floor in the run-in position.

In the FIG. 11 embodiment, the flexible line engages the roller 12 at the top of arm 10, and continues to the reel 25 on which the flexible line is coiled. In this position, line 50 engages lower roller 26. The arm 10 is thus supported on the top of the rig floor 70, and the slip bowl assembly 60 is centered above the rig floor 70 and over the well hole 72.

Figure 12:
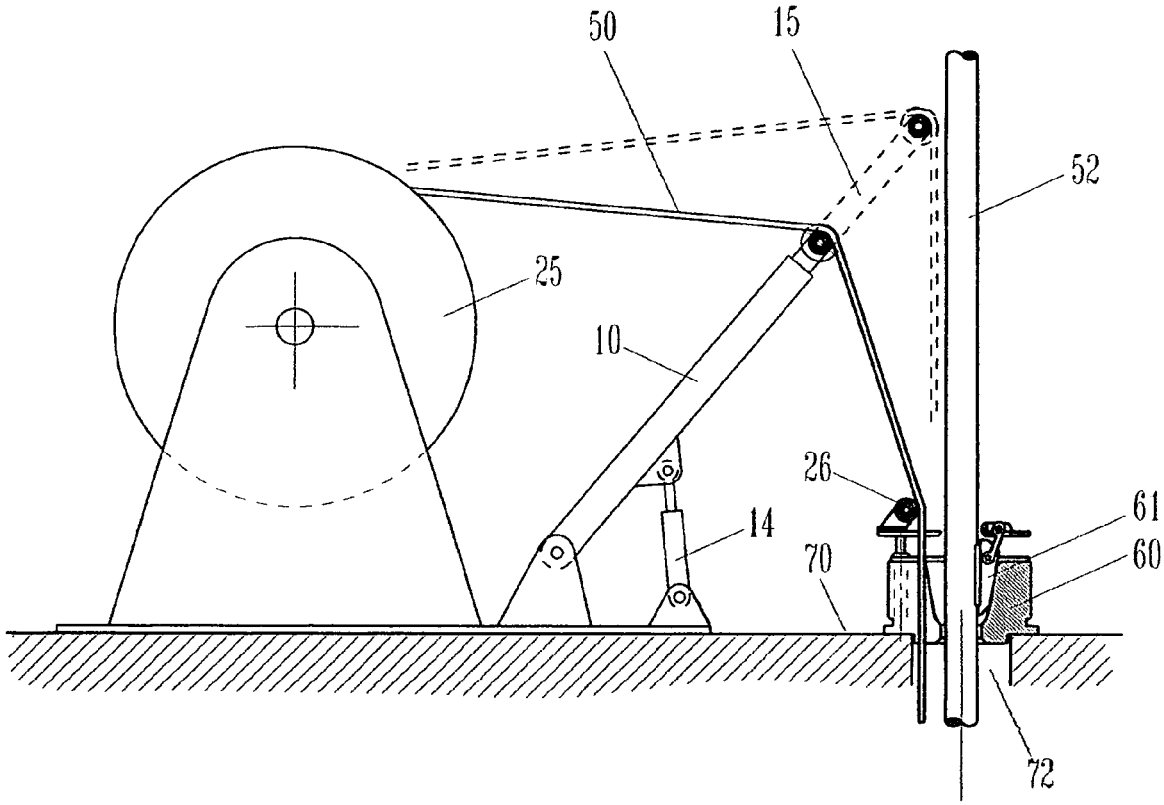
FIG. 12 is a side view of an alternate embodiment illustrating an extendable arm.
Figure 14:
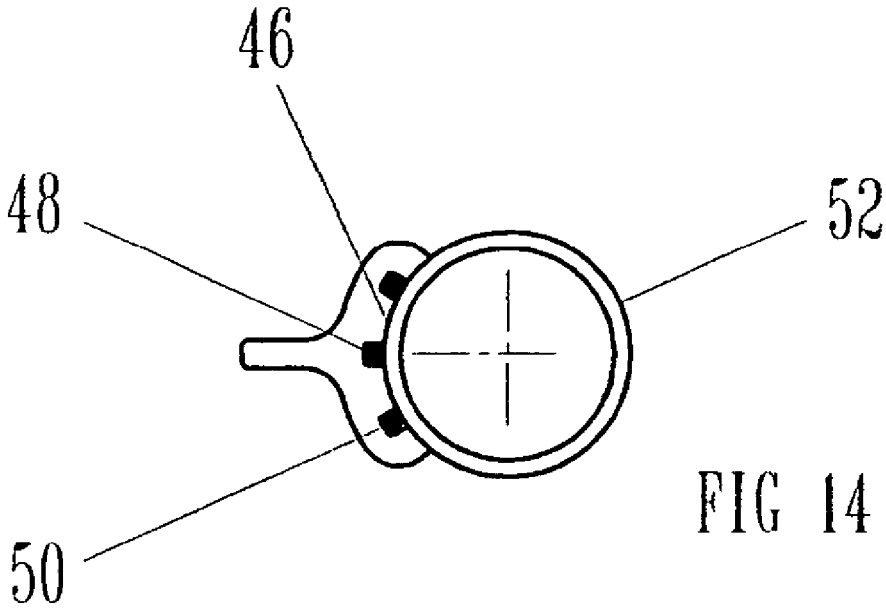
FIG. 14 is a top view of the spacer shown in FIG. 13.

FIG. 12 illustrates another embodiment of an arm 10, which in this case is extendable from a run-in position, as shown in solid lines, to a clamping position for passing the flexible line 50 and tubular 52 through the slip bowl assembly 60 centered over the well hole 72 in the rig floor 70. Both the arm and the reel 25 are thus provided on the rig floor 70. Hydraulic cylinder 14 controls the angular position of the arm 10, while hydraulic cylinder 15 within the arm 10 controls the extension and retraction of the arm between the clamping position and the run-in position. A lower roller 26 is provided on the upper end of the slip bowl assembly 60 for engaging the flexible line when in the run-in position. In alternate embodiments, the telescoping arm 10 as shown in FIG. 12 may be moved by a rack and pinion assembly or a powered cable system. A cylinder 14 effectively adjusts the angle of the arm 10, and the extension and retraction movement of the arm may be controlled by a hydraulic cylinder, a powered screw, or a plate with adjusting pin holes. The slip bowl assemblies shown in FIGS. 9, 11 and 12 are not laterally movable relative to the rig floor. In a preferred assembly, the slip bowl assembly is laterally movable, as discussed above.

FIGS. 9 and 11 illustrate another embodiment wherein the arm 10 is telescopic, with a roller 12 and adjustment mechanism 16 provided at the upper end of the arm 10.

The term "run-in position" as used herein is the position of the arm when passing the flexible line with a tubular through the well hole in the rig floor. The run-in operation typically includes a stage wherein power tongs or other equipment are used to threadably connect one tubular joint to another tubular joint, and also includes the operation of lowering the tubular with an elevator so that the elevator is positioned only several feet above the rig floor. During both of these operations, it is preferable that the flexible lines and the arm 10 be laterally spaced from the power tongs or the elevators, so that the lines are not damaged during these stages of the run-in operation. During part of the run-in operation, the flexible lines could be positioned adjacent the tubular, although it may be more practical for many applications to have the arm space the flexible lines from the tubular during the entire run-in operation, so that the run-in operation need not be interrupted by movement of the flexible lines to a position spaced form the tubular when the elevators are lowered or the tongs are used to make up a tubular connection. The slip bowl assembly 60 may thus be centered over the well hole when tongs make up a tubular connection, but the assembly 60 is moved laterally from the well hole when the elevators are lowered and the tubular is run in the hole with the flexible lines.

Figure 13:
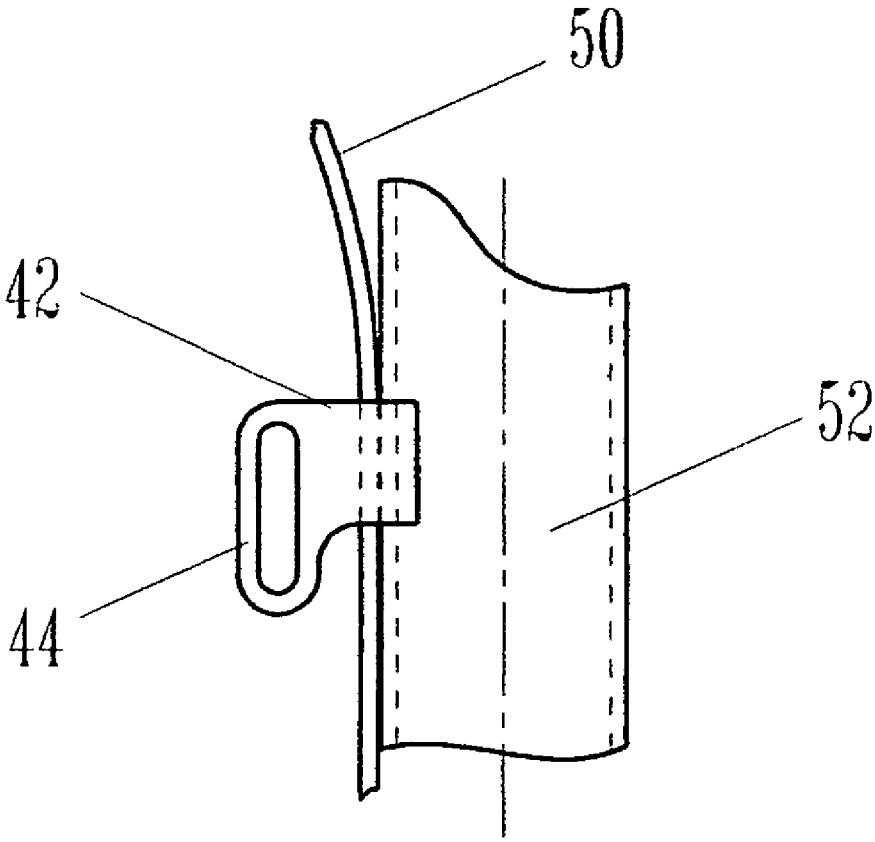
FIG. 13 depicts a flexible line spacer.

FIG. 13 illustrates the hand held line guide 42 for positioning a plurality of flexible lines 50 at a desired spacing relative to one another prior to clamping the flexible lines to the tubular 52. The guide 42 includes a handle 44 for manually grasping and manipulating the guide, and has a curved surface 46 for substantially planar contact with the outer diameter of the tubular 52. A plurality of elongate cavities 48 are provided along the curved surface 46, with each cavity 48 being sized to receive a selected one of the flexible lines 50, whether those flexible lines have a substantially circular or rectangular configuration. By using the line guide 42, an operator can properly position the flexible lines at their desired spacing relative to one another and press the flexible lines in position against the tubular 52, so that the flexible lines will be properly positioned for being received within the clamp 30 shown in FIG. 2 for final clamping of the flexible lines to the tubular 52.

Figure 16:
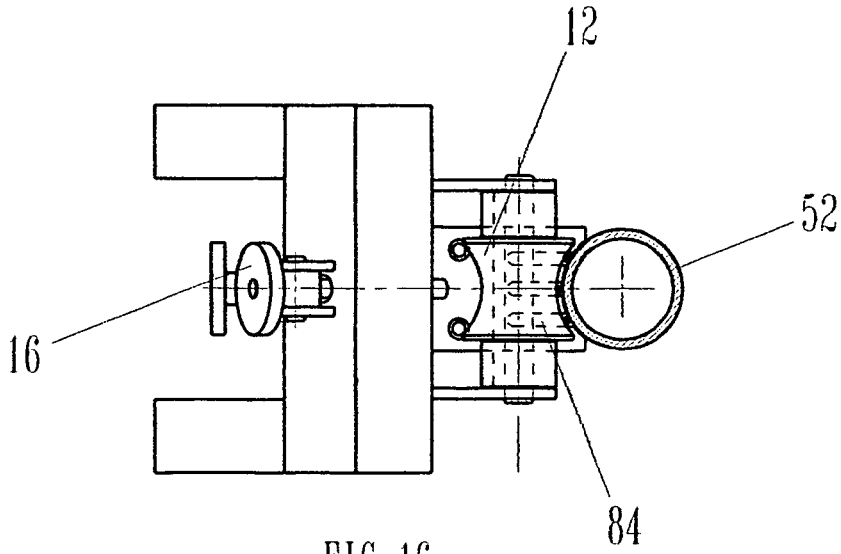
FIG. 16 is the top view of the embodiment shown in FIG. 15.
Figure 17:
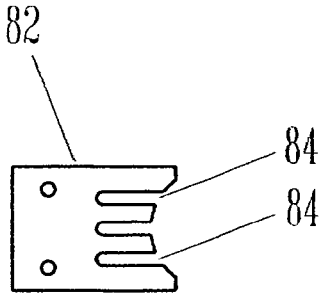
FIG. 17 is a top view of the line spacer generally shown in FIG. 15.
Figure 15:
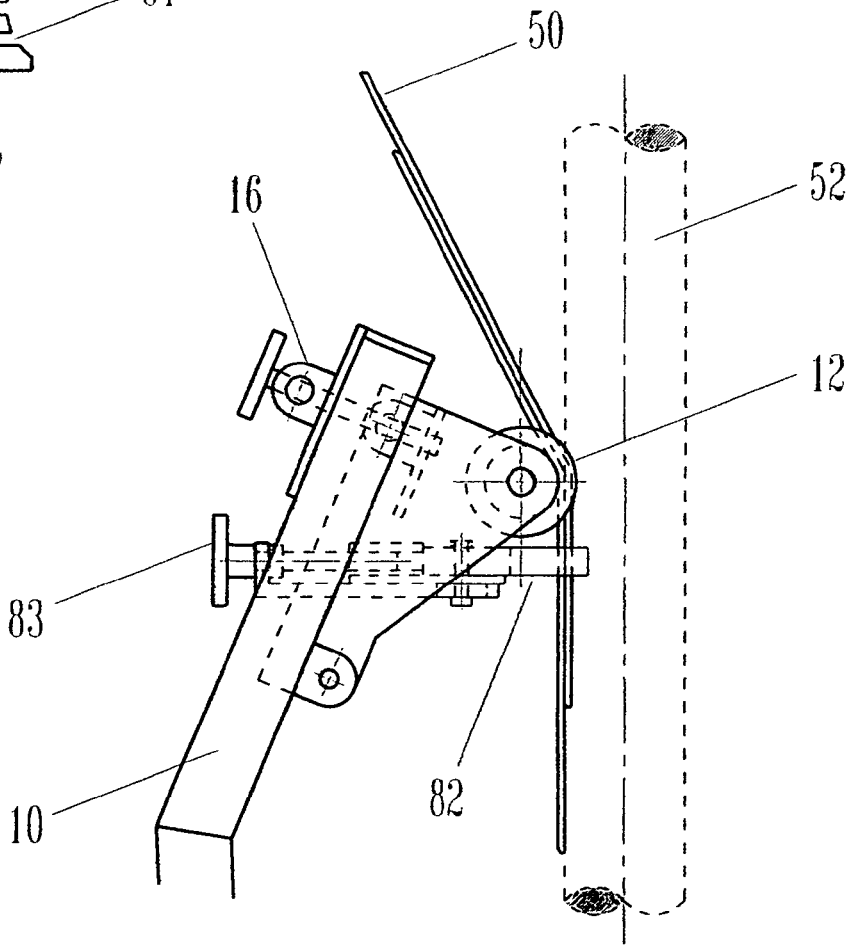
FIG. 15 is a side view of an upper portion of an arm with a line spacer adjustably positioned on the arm beneath a roller.

FIG. 15 is a side view of an upper portion of an arm 10 with a roller 12 adjustable relative to the arm by adjustment mechanism 16. The roller engages the plurality of flexible control lines 50 and positions the lines 50 adjacent the tubular for clamping the lines to the tubular with a conventional clamp. FIG. 15 also depicts a flexible line spacer 82 supported on the upper end of the arm, with the position of a flexible line spacer 82 being adjustable by adjustment mechanism 83. The line spacer 82 may be fabricated from a high wear plastic, such as ultra high molecular weight polyethylene, or may be fabricated from steel. Spacer 82 allows the flexible lines to stay on the roller when the arm 10 is moved away from the pipe, at which time the flexible lines will move back toward the rear of the slots 84, as shown in FIG. 17. The position of the roller 12 with respect to the flexible line spacer may thus be adjusted so that the flexible lines may be spaced a slight distance off the surface of the tubular 52 and still contact the roller 12. The slots 84 in the flexible line spacer 82 are shown in both the top view of FIG. 16 and the top view of the flexible line spacer as shown in FIG. 17. The width of the slot 84 may be greater than a width of a respective flexible line to minimize wear on the flexible line. In another embodiment, the flexible line spacer is movable by a fluid powered cylinder between a retracted position on the arm wherein the spacer is out of contact with the flexible lines, and an extended position wherein the flexible lines are positioned within the spacer slots. The flexible lines may be manipulated by an operator at the rig floor, if necessary, to slide within a respective spacer slot.

Figure 19:
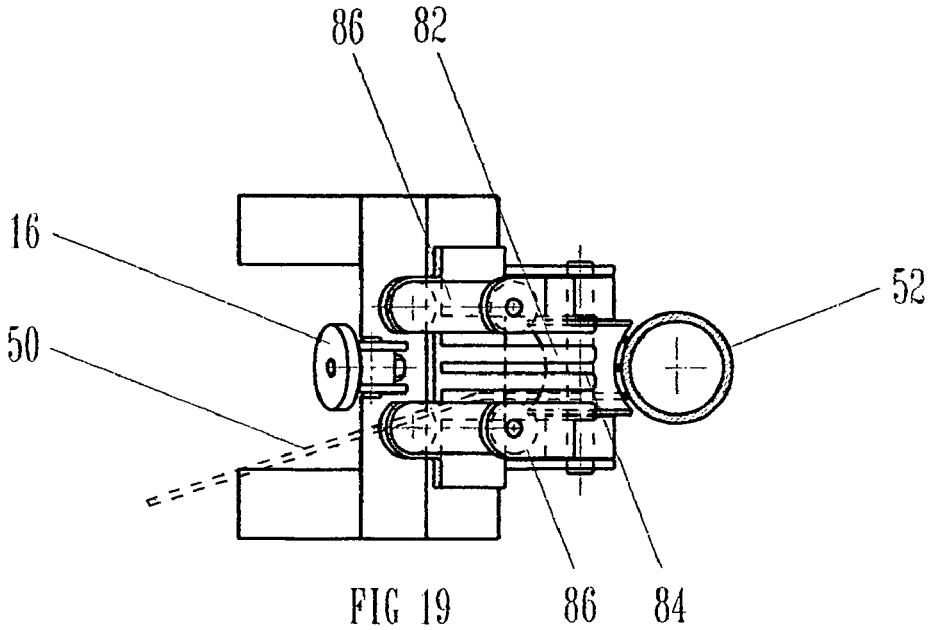
FIG. 19 is a top view of the embodiment shown in FIG. 18.
Figure 18:
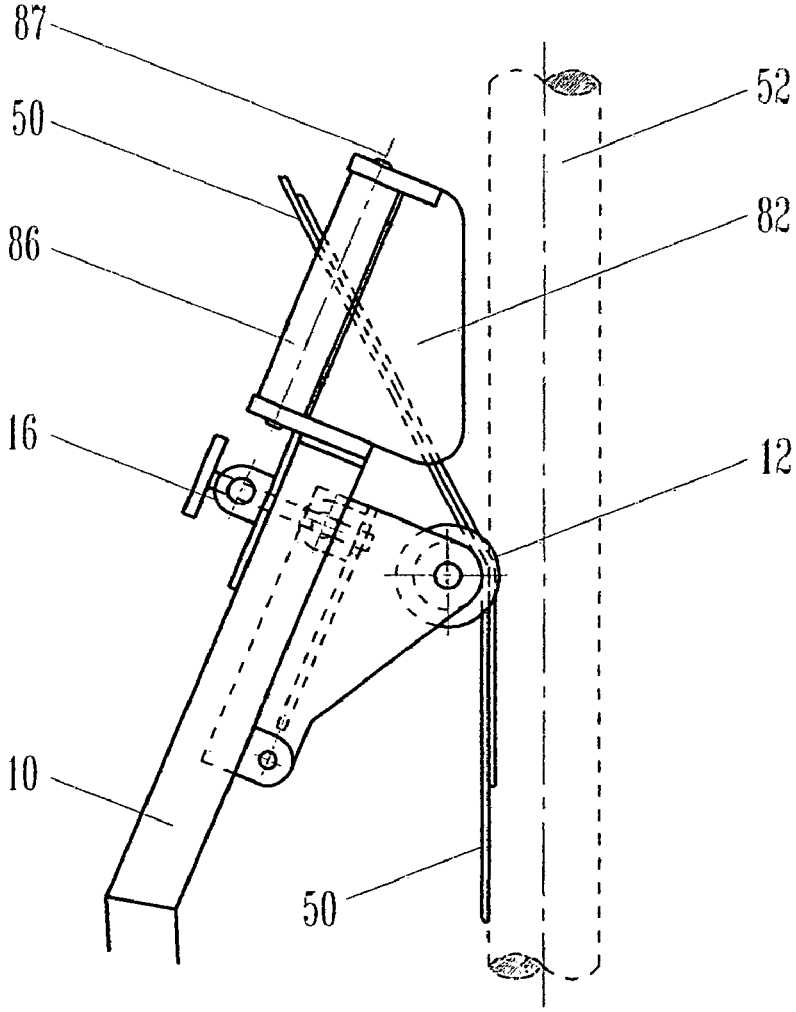
FIG. 18 is a side view of an upper portion of an arm with a line spacer positioned above the roller at the upper end of the arm.

FIG. 18 is a side view of an alternate embodiment, wherein a flexible line spacer 84 is positioned above the roller 12. As shown in FIG. 19, slots 84 in the flexible line spacer are provided, with each slot receiving one of the flexible lines 50. A plurality of rollers 86 with a substantially vertical component axis 87 are provided for guiding the flexible line 50 into position for being received with a respective slot 84 in the spacer 82, then subsequently engaged by the roller 12. When the flexible line from the spool is not in line with the arm 10, rollers 86 thus guide each of the flexible lines for passing through a respective slot in the spacer 82 prior to engaging roller 12.

Figure 21:
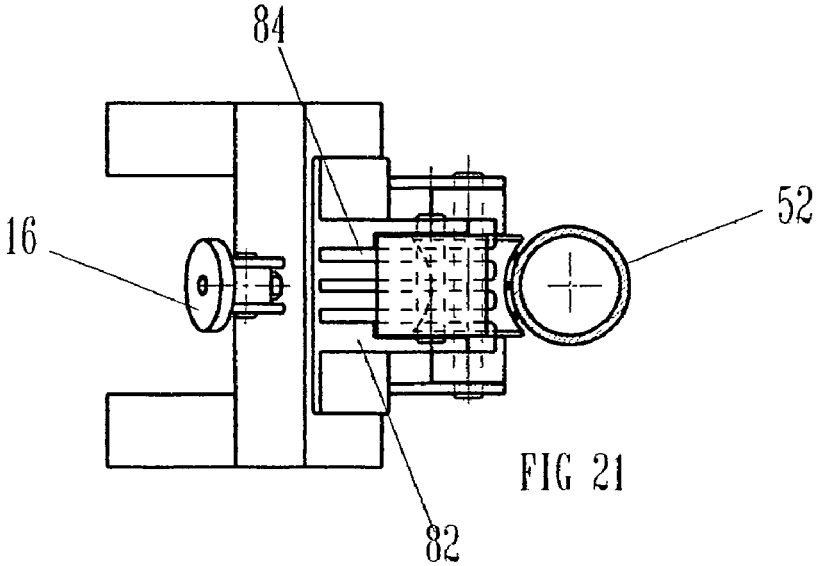
FIG. 21 is a top view of the embodiment shown in FIG. 20.
Figure 20:
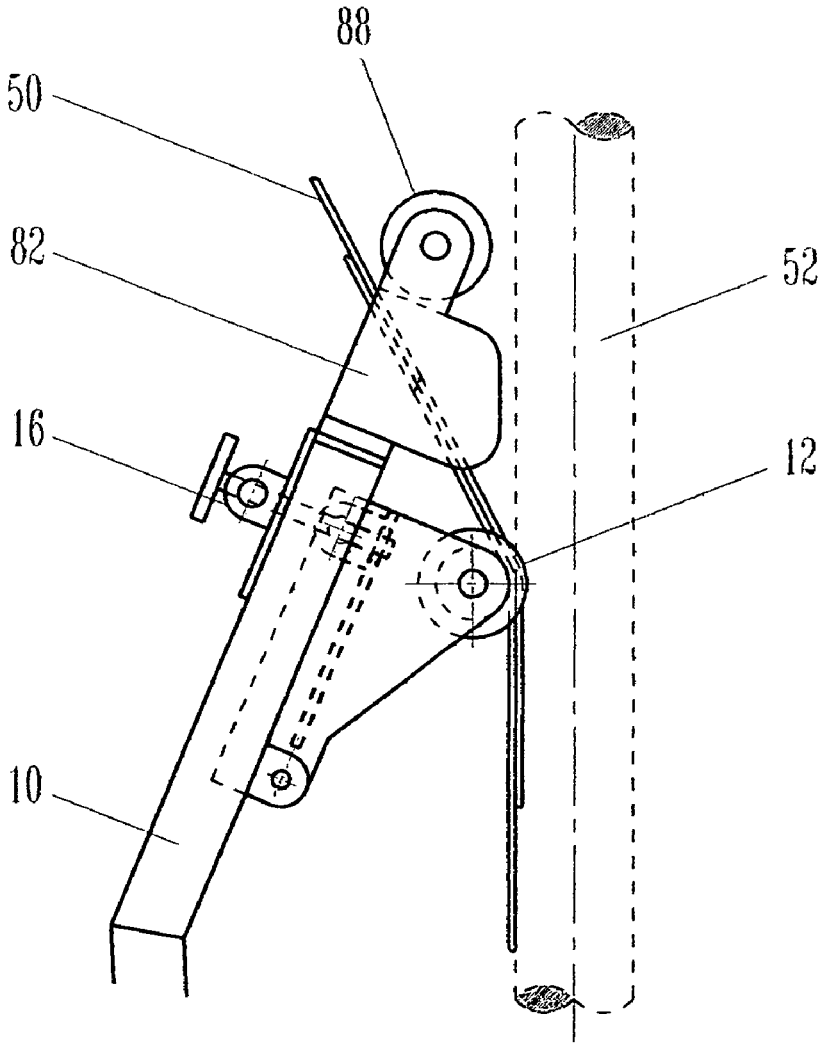
FIG. 20 is a side view of yet another embodiment depicting an upper portion of an arm, a line spacer above the roller, and another roller above the line spacer.

FIG. 20 depicts another embodiment wherein flexible line spacer 82 is provided on the arm 10 above the roller 12. With this embodiment, the top roller 88 above the spacer 82 is also provided to prevent lines from coming out of the slots in the spacer 82 when the arm is moved away from the tubular 52. FIG. 21 depicts the slots 84 in the spacer 82.

Figure 23:
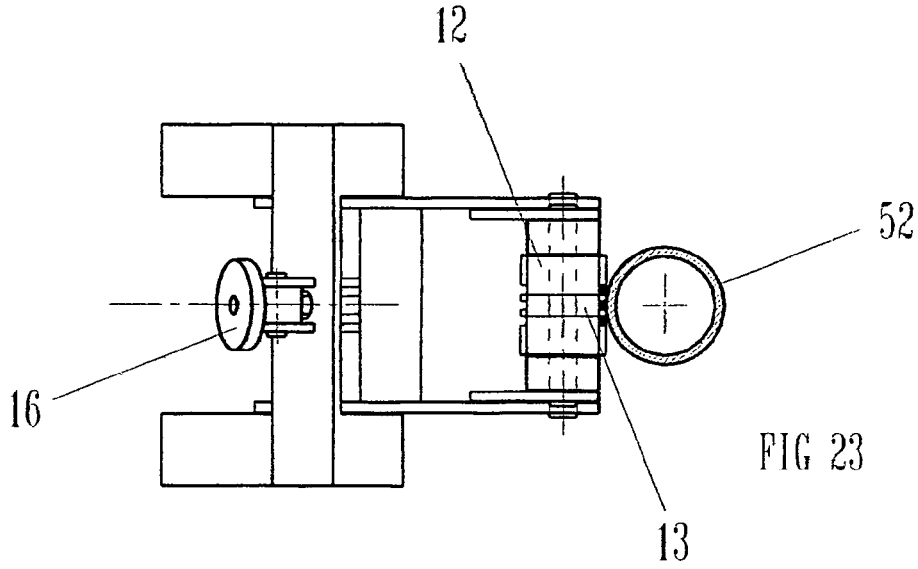
FIG. 23 is a top view of the embodiment shown in FIG. 22.
Figure 22:
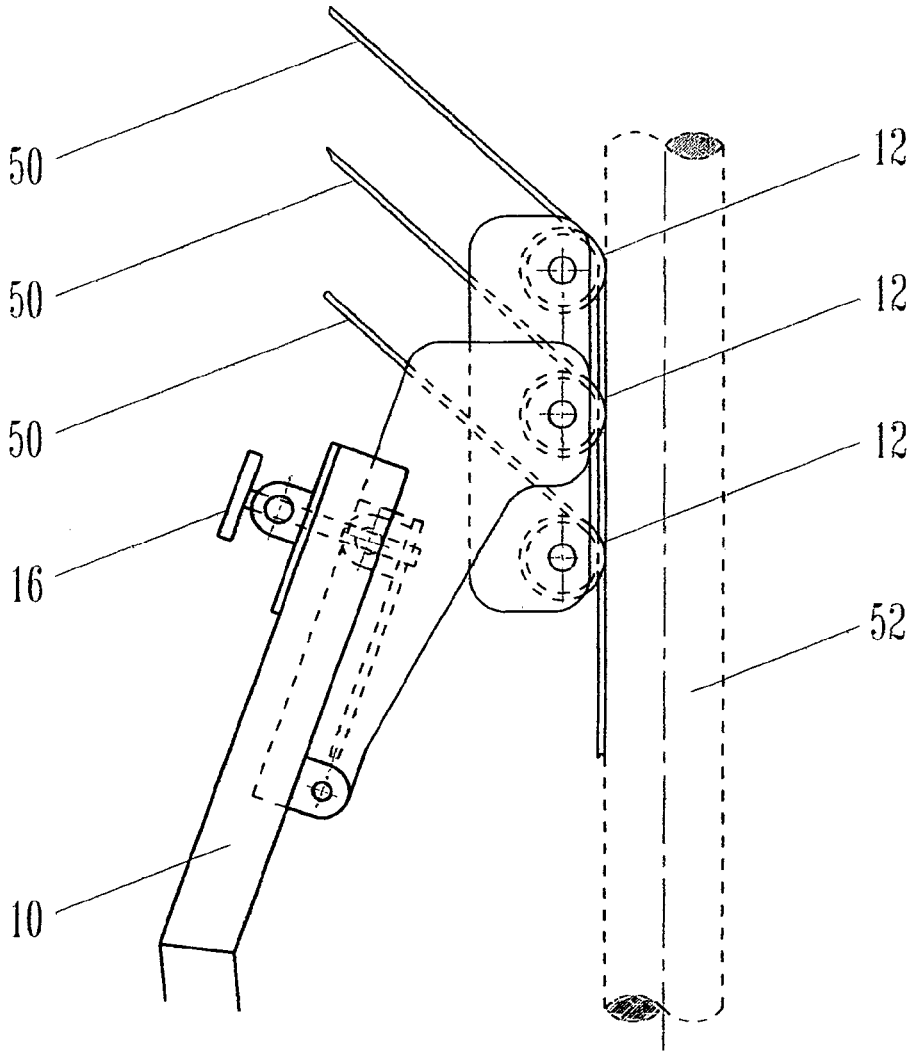
FIG. 22 is a side view of an upper portion of an arm depicting a plurality of vertically spaced rollers, with each roller receiving one of the plurality of flexible lines.

FIG. 22 discloses an alternate embodiment, wherein the upper portion of the flexible arm 10 supports a plurality of rollers 12, with each roller being provided on a respective shaft. Each roller thus engages one of the plurality of flexible lines, and positions the lines 50 against the tubular 52 for clamping the lines to the tubular. If desired, each roller 12 may include a groove 13 as shown in FIG. 23 for receiving a respective flexible line.

For each of the embodiments disclosed herein, different types and styles of line guides and flexible line spacers may be used. For example, rollers 86 as shown in FIGS. 18 and 19 thus may be provided for each of the embodiments depicted. The flexible line spacer may have various configurations and may be mounted in different positions on the arm depending on the location of the spools which store the flexible lines.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

The invention claimed is:

1. A movable arm assembly for engaging a flexible line at a well site for positioning the flexible line between a run-in position for passing the flexible line with a tubular through a well hole in the rig floor, and a clamping position wherein the flexible line is adjacent the tubular above the well hole in the rig floor for clamping the flexible line to the tubular, the movable arm comprising:

the movable arm extending upward from the rig floor;

at least one upper flexible line guide adjacent an upper end of the arm for engaging the flexible line when in the clamping position;

a slip bowl assembly movable between a position centered over the well hole for gripping the tubular and a position spaced laterally from the well hole when the arm is in the run-in position;

wherein a lower end of the arm is pivotally connected to a base of the slip bowl assembly; and a powered drive for moving the arm between the run-in position and the clamping position.

2. The movable arm assembly as defined in claim 1, wherein the flexible line guide includes a roller rotatably mounted to the arm.

3. The movable arm assembly as defined in claim 1, further comprising:

a lower roller for engaging the flexible line when the arm is in the run-in position.

4. The movable arm assembly as defined in claim 1, further comprising:

a fluid powered cylinder for moving the slip bowl assembly laterally relative to the well hole in the rig floor.

5. The moveable arm assembly as defined in claim 4, wherein a hydraulic system for moving the slip bowl assembly powers the powered drive for moving the arm.

6. The movable arm assembly as defined in claim 1, wherein the at least one upper flexible line guide comprises:

at least one roller supported on the arm; and an adjustment mechanism for adjusting the position of the at least one roller relative to the arm.

7. The movable arm assembly as defined in claim 1, wherein the powered drive comprises a fluid powered cylinder.

8. The movable arm assembly as defined in claim 1, wherein the flexible line comprises one or more electric, hydraulic or fiberoptic lines.

9. The moveable arm assembly as defined in claim 1, wherein the flexible line guide is positioned less than 10 feet above the rig floor when the arm is in the clamping position.

10. The moveable arm assembly as defined in claim 1, wherein the arm includes a lower arm portion and an upper arm portion, the upper arm portion supporting the at least one upper flexible guide and inclined relative to the lower arm portion.

11. The moveable arm assembly as defined in claim 1, further comprising:

another arm extending upward from the rig floor, the another arm supporting another flexible line guide and moveable by another powered drive.

12. The moveable arm assembly as defined in claim 1, further comprising:

a hand held line spacer for positioning two or more flexible lines at a desired spacing relative to one another prior to positioning the lines within a clamp secured to the tubular.

13. The movable arm assembly as defined in claim 1, further comprising:

a flexible line spacer supported on the arm for positioning two or more flexible lines at a desired spacing relative to one another prior to positioning the lines within a clamp secured to the tubular, the flexible line spacer having a plurality of slots each sized for receiving a respective flexible line.

14. The movable arm assembly as defined in claim 13, further comprising:

a flexible line spacer adjustment mechanism for adjusting the position of the flexible line spacer relative to the arm.

15. The movable arm assembly as defined in claim 14, wherein the flexible line spacer is adjustable relative to the flexible line guide to control the position of a flexible line within a respective slot in the flexible line spacer.

16. The movable arm assembly as defined in claim 13, wherein the flexible line spacer is provided beneath the flexible line guide.

17. The movable arm assembly as defined in claim 13, wherein the flexible line spacer is provided above the flexible line guide.

18. The movable arm assembly as defined in claim 17, further comprising:

another flexible line guide positioned above the flexible line spacer.

19. The movable arm assembly as defined in claim 1, further comprising:

the at least one upper flexible line guide comprises a plurality of rollers each mounted to the arm, each roller adapted for engagement with a respective flexible line.

20. A movable arm assembly for engaging a flexible line at a well site for positioning the flexible line between a run-in position wherein the flexible line is spaced from the tubular above the rig floor for passing the flexible line with a tubular through a well hole in the rig floor, and a clamping position wherein the flexible line is adjacent the tubular above the well hole in the rig floor for clamping the flexible line to the tubular, the movable arm comprising:

the arm extending upward from a slip bowl assembly;

at least one upper flexible line guide adjacent an upper end of the arm for engaging the flexible line when in the clamping position;

a fluid powered cylinder for moving the arm between the run-in position and the clamping position;

the slip bowl assembly movable between a position centered over the well hole for gripping the tubular and a position spaced laterally from the well hole when the arm is in the run-in position; and wherein a hydraulic system for powering the slip bowl assembly powers the powered drive for moving the arm.

21. The movable arm assembly as defined in claim 20, wherein the flexible line guide is a roller rotatably mounted to the arm.

22. The movable arm assembly as defined in claim 20, wherein the at least one upper flexible line guide comprises:

at least one roller supported on the arm; and an adjustment mechanism for adjusting the position of the at least one roller relative to the arm.

23. The moveable arm assembly as defined in claim 20, wherein the flexible line guide is positioned less than 10 feet above the rig floor when the arm is in the clamping position.

24. The movable arm assembly as defined in claim 20, further comprising:

a flexible line spacer supported on the arm for positioning two or more flexible lines at a desired spacing relative to one another prior to positioning the lines within a clamp secured to the tubular, the flexible line spacer having a plurality of slots each sized for receiving a respective flexible line.

25. The movable arm assembly as defined in claim 24, further comprising:

a flexible line spacer adjustment mechanism for adjusting the position of the flexible line spacer relative to the arm.

26. The movable arm assembly as defined in claim 24, wherein the flexible line spacer is provided beneath the flexible line guide.

27. The movable arm assembly as defined in claim 24, wherein the flexible line spacer is provided above the flexible line guide.

28. A method of engaging a flexible line at a well site for positioning the flexible line between a run-in position for passing the flexible line with a tubular through a well hole in the rig floor, and a clamping position wherein the flexible line is adjacent the tubular above the well hole in the rig floor for clamping the flexible line to the tubular, the method comprising:

extending an arm upward from the rig floor;

providing at least one upper flexible line guide adjacent an upper end of the arm for engaging the flexible line when in the clamping position;

supporting a flexible line spacer on the arm for positioning two or more flexible lines at a desired spacing relative to one another prior to positioning the lines within a clamp secured to the tubular, the flexible line spacer having a plurality of slots each sized for receiving a respective flexible line; and activating a powered drive for moving the arm between the run-in position and the clamping position.

29. The method as defined in claim 28, further comprising:

positioning two or more flexible lines at a desired spacing relative to one another using a line spacer prior to positioning the flexible lines in a clamp secured to the tubular.

30. The method as defined in claim 28, further comprising:

providing an adjustment mechanism for adjusting the position of the at least one guide relative to the arm.

31. The method as defined in claim 28, wherein the flexible line guide is positioned less than 10 feet above the rig floor when the arm is in the clamping position.

32. The method as defined in claim 28, wherein a hydraulic system for laterally moving a slip bowl assembly relative to the well hole in the rig floor also powers the powered drive for moving the arm.

33. The method as defined in claim 28, further comprising:

positioning a hand-held spacer to capture two or more flexible lines at a desired spacing relative to one another prior to positioning the lines within a clamp secured to the tubular.

34. The method as defined in claim 28, further comprising:

providing a flexible line spacer adjustment mechanism for adjusting the position of the flexible line spacer relative to the arm.

35. The method as defined in claim 28, wherein the flexible line spacer is provided beneath the flexible line guide.

36. The method as defined in claim 28, wherein the flexible line spacer is provided above the flexible line guide.

37. A movable arm assembly for engaging a flexible line at a well site for positioning the flexible line between a run-in position for passing the flexible line with a tubular through a well hole in the rig floor, and a clamping position wherein the flexible line is adjacent the tubular above the well hole in the rig floor for clamping the flexible line to the tubular, the movable arm comprising:

the movable arm extending upward from the rig floor, the arm movable telescopically to position an upper end of the arm vertically from the rig floor between the run-in position and the clamping position;

at least one upper flexible line guide adjacent an upper end of the arm for engaging the flexible line when in the clamping position;

a flexible line guide adjustment mechanism for adjusting the position of the at least one upper flexible line guide relative to the arm; and a powered drive for moving the arm between the run-in position and the clamping position.

38. The movable arm assembly as defined in claim 37, wherein the flexible line comprises one or more electric, hydraulic or fiberoptic lines.

39. The moveable arm assembly as defined in claim 37, wherein the flexible line guide is positioned less than 10 feet above the rig floor when the arm is in the clamping position.

40. The moveable arm assembly as defined in claim 37, further comprising:

another arm extending upward from the rig floor, the another arm supporting another flexible line guide and moveable by another powered drive.

41. The movable arm assembly as defined in claim 37, further comprising:

the at least one upper flexible line guide comprises a plurality of rollers each mounted to the arm, each roller adapted for engagement with a respective flexible line.

42. A movable arm assembly for engaging a flexible line at a well site for positioning the flexible line between a run-in position for passing the flexible line with a tubular through a well hole in the rig floor, and a clamping position wherein the flexible line is adjacent the tubular above the well hole in the rig floor for clamping the flexible line to the tubular, the movable arm comprising:

the movable arm extending upward from the rig floor;

a flexible line spacer supported on the arm for positioning two or more flexible lines at a desired spacing relative to one another prior to positioning the lines within a clamp secured to the tubular, the flexible line spacer having a plurality of slots each sized for receiving a respective flexible line;

at least one upper flexible line guide adjacent an upper end of the arm for engaging the flexible line when in the clamping position; and a powered drive for moving the arm between the run-in position and the clamping position.

43. The movable arm assembly as defined in claim 42, wherein the flexible line comprises one or more electric, hydraulic or fiberoptic lines.

44. The moveable arm assembly as defined in claim 42, wherein the flexible line guide is positioned less than 10 feet above the rig floor when the arm is in the clamping position.

45. The moveable arm assembly as defined in claim 42, wherein the arm includes a lower arm portion and an upper arm portion, the upper arm portion supporting the at least one upper flexible guide and inclined relative to the lower arm portion.

46. The moveable arm assembly as defined in claim 42, further comprising:

another arm extending upward from the rig floor, the another arm supporting another flexible line guide and moveable by another powered drive.

47. The movable arm assembly as defined in claim 42, further comprising:

a flexible line guide adjustment mechanism for adjusting the position of the flexible line spacer relative to the arm.

48. The movable arm assembly as defined in claim 42, further comprising:

the at least one upper flexible line guide comprises a plurality of rollers each mounted to the arm, each roller adapted for engagement with a respective flexible line.

49. A movable arm assembly for engaging a flexible line at a well site for positioning the flexible line between a run-in position for passing the flexible line with a tubular through a well hole in the rig floor, and a clamping position wherein the flexible line is adjacent the tubular above the well hole in the rig floor for clamping the flexible line to the tubular, the movable arm comprising:

the movable arm extending upward from the rig floor to selectively position an upper end of the arm vertically from the rig floor;

at least one upper flexible line guide adjacent an upper end of the arm for engaging the flexible line when in the clamping position;

a lower roller adjacent a lower end of the arm for engaging the flexible line when the arm is in the run-in position; and a flexible line spacer supported on the arm for positioning two or more flexible lines at a desired spacing relative to one another prior to positioning the lines within a clamp secured to the tubular, the flexible line spacer having a plurality of slots each sized for receiving a respective flexible line.

50. The movable arm assembly as defined in claim 49, wherein the flexible line guide includes a roller rotatably mounted to the arm.

51. The movable arm assembly as defined in claim 49, wherein the at least one upper flexible line guide comprises:

an adjustment mechanism for adjusting the position of the at least one upper flexible line guide.

52. The moveable arm assembly as defined in claim 49, wherein the flexible line guide is positioned less than 10 feet above the rig floor when the arm is in the clamping position.

53. The moveable arm assembly as defined in claim 49, wherein the arm includes a lower arm portion and an upper arm portion, the upper arm portion supporting the at least one upper flexible guide and inclined relative to the lower arm portion.

54. The moveable arm assembly as defined in claim 49, further comprising:

a hand held line spacer for positioning two or more flexible lines at a desired spacing relative to one another prior to positioning the lines within a clamp secured to the tubular.

55. A movable arm assembly for engaging a flexible line at a well site for positioning the flexible line between a run-in position for passing the flexible line with a tubular through a well hole in the rig floor, and a clamping position wherein the flexible line is adjacent the tubular above the well hole in the rig floor for clamping the flexible line to the tubular, the movable arm comprising:

the movable arm extending upward from the rig floor, a base plate for pivotally supporting the arm and stationary with respect to the rig floor;

at least one upper flexible line guide adjacent an upper end of the arm for engaging the flexible line when in the clamping position;

a flexible line spacer supported on the arm for positioning two or more flexible lines at a desired spacing relative to one another prior to positioning the lines within a clamp secured to the tubular, the flexible line spacer having a plurality of slots each sized for receiving a respective flexible line;

a fluid powered cylinder for moving the arm between the run-in position and the clamping position; and another fluid powered cylinder for telescopically extending and retracting the arm to vary a spacing between the upper flexible line guide and the base plate.

56. The movable arm assembly as defined in claim 55, wherein the flexible line guide is a roller rotatably mounted to the arm.

57. The movable arm assembly as defined in claim 55, wherein the at least one upper flexible line guide comprises:

an adjustment mechanism for adjusting the position of the at least one upper flexible line guide relative to the arm.

58. The moveable arm assembly as defined in claim 55, wherein the flexible line guide is positioned less than 10 feet above the rig floor when the arm is in the clamping position.

* * * * *